US008764587B2

(12) United States Patent
Sinanis et al.

(10) Patent No.: US 8,764,587 B2
(45) Date of Patent: Jul. 1, 2014

(54) MULTI-USE GOLF DEVICE

(76) Inventors: George Sinanis, West Bloomfield, MI (US); John Turcotte, Cmmmerce Township, MI (US)

( * ) Notice: Subject to any disclaimer, the term of this patent is extended or adjusted under 35 U.S.C. 154(b) by 141 days.

(21) Appl. No.: 13/429,425

(22) Filed: Mar. 25, 2012
(Under 37 CFR 1.47)

(65) Prior Publication Data

US 2013/0079180 A1 Mar. 28, 2013

Related U.S. Application Data

(60) Provisional application No. 61/473,717, filed on Apr. 8, 2011, provisional application No. 61/506,094, filed on Jul. 9, 2011.

(51) Int. Cl.
*A63B 57/00* (2006.01)

(52) U.S. Cl.
USPC ..... 473/387; 473/396; 473/408

(58) Field of Classification Search
USPC ..... 473/387–403, 408; D21/717, 718
See application file for complete search history.

(56) References Cited

U.S. PATENT DOCUMENTS

| | | | | |
|---|---|---|---|---|
| 1,625,911 | A * | 4/1927 | Richards | 473/398 |
| 1,638,448 | A * | 8/1927 | Manson | 473/394 |
| 1,936,625 | A * | 11/1933 | Goldman | 473/398 |
| 3,114,557 | A * | 12/1963 | Cabot | 473/398 |
| 3,203,700 | A * | 8/1965 | Antonious | 473/257 |
| 3,408,079 | A * | 10/1968 | Kirikos | 473/398 |
| 3,606,344 | A * | 9/1971 | Ball | 473/398 |
| 3,782,723 | A * | 1/1974 | Morris | 473/403 |
| D316,286 | S * | 4/1991 | Johnson | D21/718 |
| 5,052,689 | A * | 10/1991 | Lettrich | 473/257 |
| 5,211,395 | A | 5/1993 | Liao | |
| 5,672,122 | A * | 9/1997 | Strong | 473/398 |
| 6,729,977 | B1 * | 5/2004 | Young et al. | 473/398 |
| D518,864 | S | 4/2006 | Bradshaw | |
| 7,238,126 | B1 * | 7/2007 | Wiens et al. | 473/408 |
| D554,726 | S | 11/2007 | Blanks | |
| 7,416,498 | B2 * | 8/2008 | Kihara | 473/394 |
| 7,488,263 | B2 * | 2/2009 | Lee | 473/394 |
| 7,611,426 | B1 | 11/2009 | Bradshaw | |
| 7,699,722 | B1 * | 4/2010 | Neu et al. | 473/400 |
| 7,731,609 | B2 | 6/2010 | Wiens et al. | |
| 7,815,529 | B2 * | 10/2010 | Lee | 473/398 |

(Continued)

FOREIGN PATENT DOCUMENTS

| | | |
|---|---|---|
| GB | 2222090 | 2/1990 |
| WO | WO95/19818 | 7/1995 |

OTHER PUBLICATIONS

Search Report, Jun. 21, 2012.

*Primary Examiner* — Steven Wong
(74) *Attorney, Agent, or Firm* — Fraser Clemens Martin & Miller LLC; William A. Ziehler

(57) ABSTRACT

A multi-use golf device is able to be used as a golf tee and as a divot repair tool. The multi-use golf device includes two portions that move relative to one another to change a configuration of the multi-use golf device. In a first configuration the multi-use device is generally extended and can hold a golf ball above a ground level. In a second configuration two portions of the multi-use golf device can be positioned near each other to repair a divot in a golf course putting green.

20 Claims, 13 Drawing Sheets

(56) References Cited

U.S. PATENT DOCUMENTS

| | | | | |
|---|---|---|---|---|
| D637,677 | S | 5/2011 | Bradshaw | |
| 2003/0148830 | A1* | 8/2003 | Hsiao | 473/387 |
| 2005/0026726 | A1* | 2/2005 | Barouh | 473/398 |
| 2006/0166765 | A1* | 7/2006 | Holtzman | 473/387 |
| 2006/0199669 | A1* | 9/2006 | Barouh | 473/398 |
| 2007/0111826 | A1* | 5/2007 | Blanks | 473/408 |
| 2009/0088274 | A1* | 4/2009 | Blais | 473/398 |

* cited by examiner

MULTI-USE GOLF DEVICE

CROSS-REFERENCE TO RELATED APPLICATIONS

This application claims the benefit of U.S. Provisional Application No. 61/473,717, filed on Apr. 8, 2011, entitled Multi Use Golf Tee and U.S. Provisional Application No. 61/506,094, filed on Jul. 9, 2011, entitled Combination Tee and Divot Tool. The entire disclosures of each of the above applications are incorporated herein by reference.

FIELD

The subject disclosure relates to an apparatus for use during the playing of golf, and particularly to a multi-use apparatus for use at a tee box and a green during a game of golf.

SUMMARY

This section provides a general summary of the disclosure, and is not a comprehensive disclosure of its full scope or all of its features.

A multi-use golf device, also referred to as a golf tool system or multi-use tee, which can include a golf tee and divot tool in combination is illustrated and disclosed. The golf tool system can be adjusted to be used in various and different useful fashions. For example, the golf tool system can be a multiple use or adjustable golf tool system for use as a golf tee and a divot repair tool. The golf tool system can include a tee body member and a Divot Tool Plow (DTP) member.

During a round of golf multiple implements are used by a golfer to play an array of shots and to perform tasks on the golf course. For example, when hitting an initial shot a golfer may place a golf ball on a tee or other stand device, within the rules of golf. The tee device is generally a single use device which does not provide any other practical use during a round of golf. Additionally, golf clubs can be used to hit various shots and provide a golfer with the ability to advance the ball from the teeing ground to a green. The green is generally exceptionally smooth that is susceptible to being marred or marked by the impact of a golf ball on the green. A courteous golfer often repairs the green to remove the mark and replace the smoothness of the green after the ball has been putted into the hole on the green. A separate, individual, and equally single use device is often used by a golfer to repair the damage to the green.

The multi-use golf device is able to be used as a golf tee and as a divot repair tool. The multi-use golf device includes two portions that move relative to one another to change a configuration of the multi-use golf device. In a first configuration the multi-use golf device is generally extended and can hold a golf ball above a ground level. In a second configuration two portions of the multi-use golf device can be positioned near each other to repair a divot in a golf course putting green.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 33:
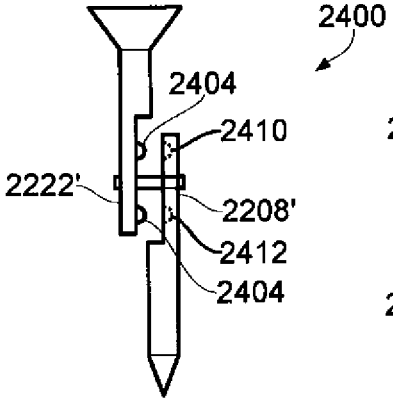
Figure 36:
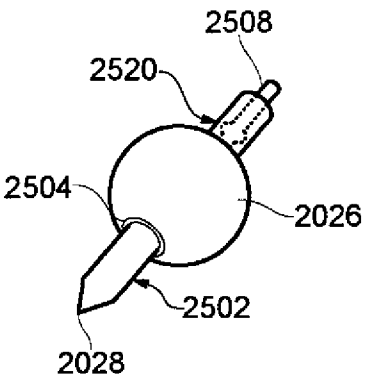
Figure 35:
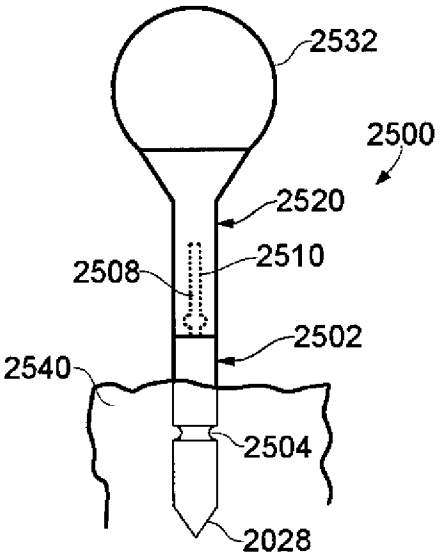
Figure 34A:
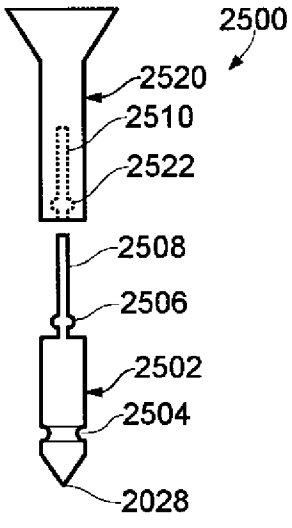
Figure 34B:
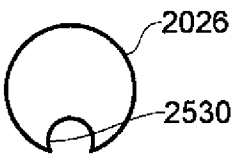

FIG. 33 side exploded view of a multi-use golf device according to various embodiments;

FIG. 34A is a front exploded view of a multi-use golf device according to various embodiments;

FIG. 34B is a detail view of a ball engagement region of the multi-use golf device;

FIG. 35 is an environmental view of the multi-use golf device of FIG. 34A; and FIG. 36 is a divot tool configuration of the multi-use golf device of FIG. 34A.

Corresponding reference numerals indicate corresponding parts throughout the several views of the drawings.

DETAILED DESCRIPTION

Example embodiments will now be described more fully with reference to the accompanying drawings.

According to FIGS. 1-8 a multi-use golf device 10 includes a tee body 12 and a divot tool plow (DTP) 14. The tee body 12 extends from a head portion 16 to a tee tip 18. The tee tip 18 is generally configured or operable to be pushed into a surface to hold a golf ball on the head portion 16. The tip 18 can also be flattened or generally not circular for engagement into a surface. The multi-use golf device 10, and according to other embodiments illustrated herein, allows for adjustment of a single tool for multiple purposes. Moreover, the DTP 14 allows the system 10 to be adjustable for various purposes, as discussed herein, including amount of soil to move, teeing position, cleaning, etc.

The tee body 12 can further include a first region 20 near the head portion 16 that has a diameter greater than a distal portion 22 near the tip 18. A projection or stop 24 can be formed near the tip 18 as well. The first region 20 and the projection 24 can cooperate with the DTP 14 to substantially limit the travel of the DTP 14 and maintain the DTP 14 on the tee body 12.

Figure 5:
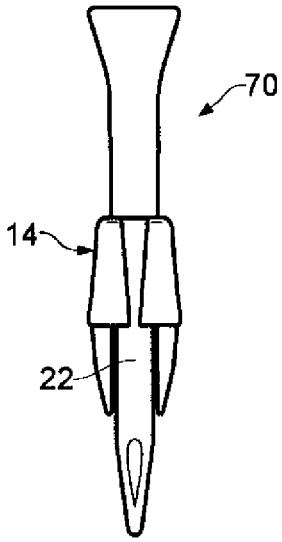
FIG. 5 is a back plan view of the multi-use golf device including a tee body and a Divot Tool Plow (DTP) having engaging spikes in a retraced position.
Figure 6:
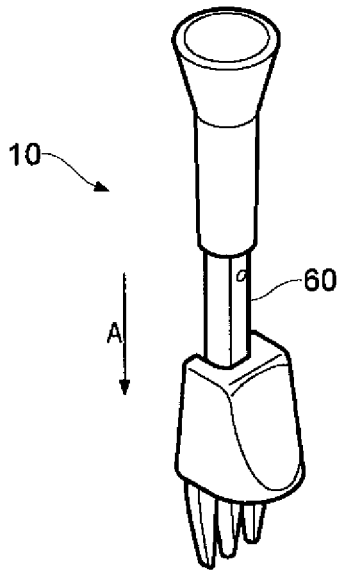
FIG. 6 is a perspective view of the multi-use golf device including a tee body and a Divot Tool Plow (DTP) having engaging spikes in an extended position.
Figure 7:
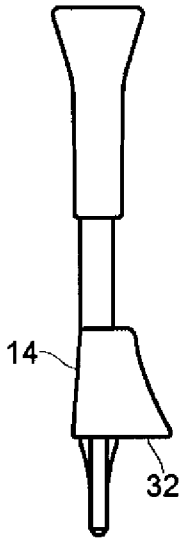
FIG. 7 is a side plan view of the multi-use golf device including a tee body and a Divot Tool Plow (DTP) having engaging spikes in an extended position.
Figure 8:
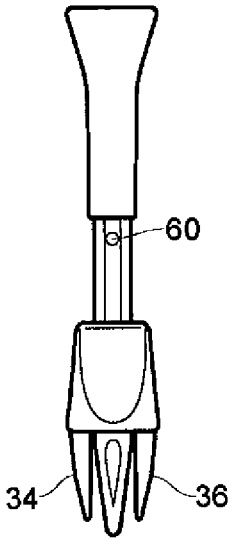
FIG. 8 is a front plan view of the multi-use golf device including a tee body and a Divot Tool Plow (DTP) having engaging spikes in an extended position.

The DTP 14 can include a depression 30 to assist a user in operating the DTP 14. The DTP 14 can be moved along the tee body 12 between a retracted position near the head 16, as illustrated in FIGS. 1-5, and an extended position as illustrated in FIGS. 6-8. The DTP 14 can further include a plow surface 32 that can be used to engage a surface, such as a mound of dirt (similar to the surface 2028 illustrated in FIG. 25). The DTP 14 can also include one or more projections or spikes 34 and 36. The spikes 34 and 36 can be used in combination with the tip 18 to provide a surface area for engaging a surface, such as a mound of dirt to repair a divot or ball mark on a green surface. It is understood that the spikes 34 and 36 increase a surface area greater than that of the tip 18 alone. It is understood, that any appropriate or selected number of spikes can be provided from the DTP 14.

Figure 9:
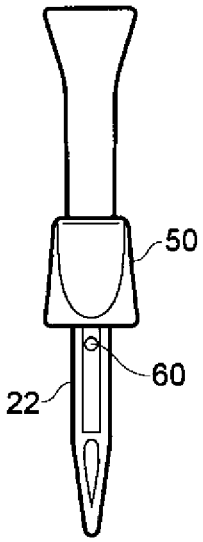
FIG. 9 is a perspective view of a multi-use golf device according to a second embodiment including a tee body and a Divot Tool Plow (DTP) in a retracted position.
Figure 10:
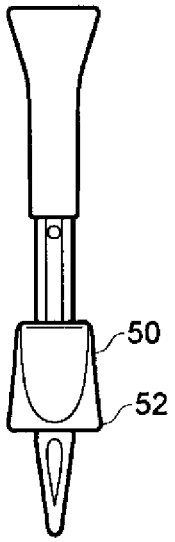
FIG. 10 is a plan view of a multi-use golf device according to the second embodiment including a tee body and a Divot Tool Plow (DTP) in a extended position.
Figure 11:
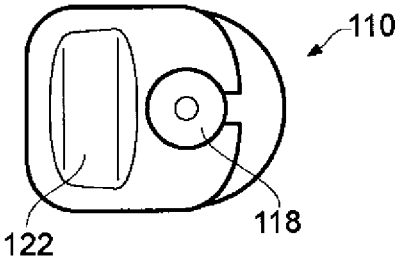
FIG. 11 is a bottom plan view of a multi-use golf device according to a third embodiment including a tee body and a Divot Tool Plow (DTP)
Figure 12:
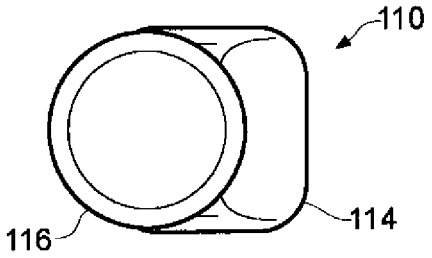
FIG. 12 is a top plan view of a multi-use golf device according to the third embodiment including a tee body and a Divot Tool Plow (DTP)
Figure 13:
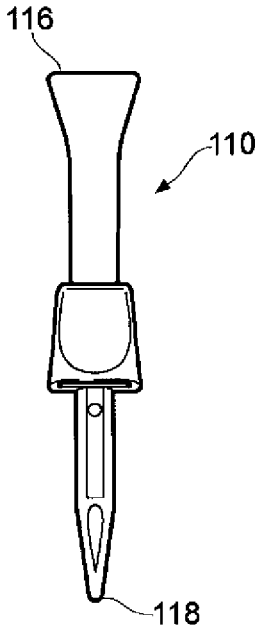
FIG. 13 is a front plan view of a multi-use golf device according to the third embodiment including a tee body and a Divot Tool Plow (DTP)

As illustrated in FIG. 9, according to various embodiments, a DTP 50 need not include spikes. The DTP 50 can also move from a retracted position or tee position, as illustrated in FIG. 9, to an extended or divot tool position, as illustrated in FIG. 10. The DTP 50 can be used alone without spikes when in the divot tool configuration, as illustrated in FIG. 10. For example, a bottom or selected surface 52, similar to the surface 32, can be to engage a ground surface to assist in repair of a divot. Further, the bottom surface 52 can form an obtuse angle with a long axis of the body 12.

Figure 1:
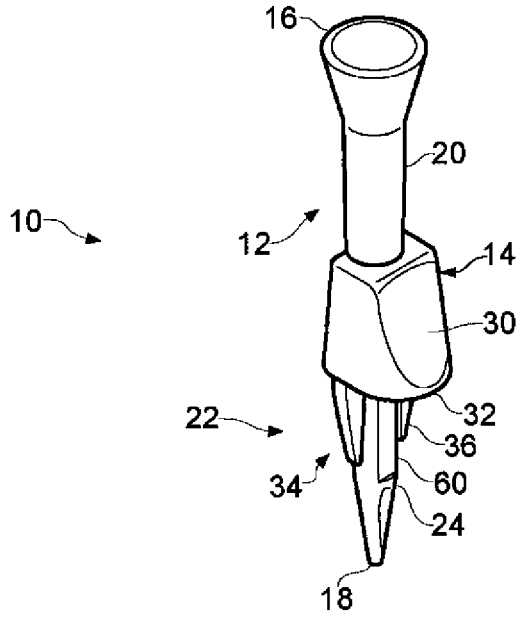
FIG. 1 is a perspective view of a multi-use golf device including a tee body and a Divot Tool Plow (DTP) having engaging spikes in a retraced position.
Figure 2:
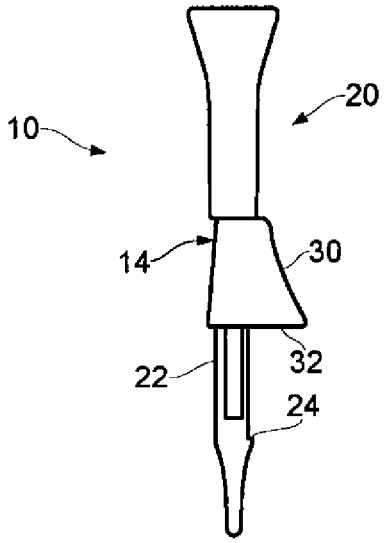
FIG. 2 is a side plan view of the multi-use golf device including a tee body and a Divot Tool Plow (DTP) having engaging spikes in a retraced position.
Figure 3:
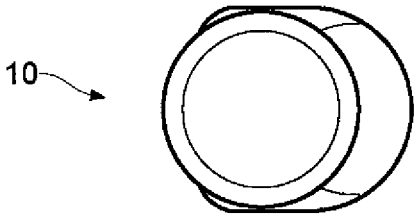
FIG. 3 is a top plan view of the multi-use golf device including a tee body and a Divot Tool Plow (DTP) having engaging spikes in a retraced position.
Figure 4:
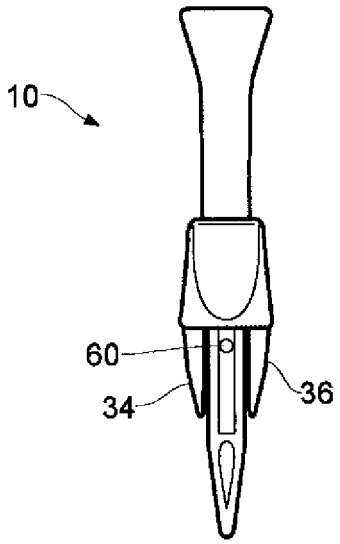
FIG. 4 is a front plan view of the multi-use golf device including a tee body and a Divot Tool Plow (DTP) having engaging spikes in a retraced position.

The tee distal portion 22 along which the DTP 14 can move can include one or more detents 60. For example, a first detent can be used to assist in holding the DTP 14 in the tee configuration (as illustrated in FIG. 1) and a second detent can be positioned near the tip 18 to assist in holding the DTP 14 near the tip 18 in the divot repair configuration (when the DTP 14 is moved in the direction of arrow A as illustrated in FIG. 6-8). It is understood, that a plurality of detents can be provided along the length of the distal portion 22 to assist in holding the DTP 14 in a plurality of positions. For example, this can be used to assist in defining a tee head position above a ground surface when inserted.

The DTP 14 can be positioned on the distal portion 22 in a selected manner. As illustrated in FIG. 5 the DTP 14 may include a split or release portion 70 (which can be an open or un-enclosed throughbore) to assist in snapping or pushing the DTP 14 over the distal portion 22. Alternatively, or in addition thereto, the DTP 14 may also be slid over the tip 18 to a selected position on the distal portion.

Figure 25:
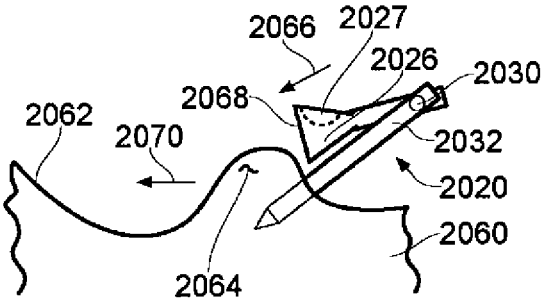
FIG. 25 is a side elevation environmental view of a multi-use golf device according to the embodiments illustrated in FIG. 22 in a divot repair configuration.

The DTP (according to the various embodiments, including the DTPs 14, 50) defines a surface, which can be referred to as a push surface, to enable a user to push against another surface, such as a mound of dirt that is formed from a ball mark on a green. The push surface can form an angle greater than 80 degrees, including greater than 90, or any appropriate obtuse angle relative to the distal tee body 22. As is generally understood, a force of a golf ball impacting a golf putting green can form a mound of dirt near a depression generally referred to as a divot or ball mark, as illustrated in FIG. 25. This combination forms a divot that can be repaired by a user. The DTP can be used to push down the mound of dirt and to repair ball mark.

The multi-use golf device includes a tee tip that enables dirt to be moved, e.g. pushed down, the golf tee tip 18 can be used in combination with the DTP. The tee tip 18 also can be used to lift the dirt prior to pushing with the DTP.

The DTP section is adjustable. It can lock in multiple positions (e.g. with the detents 60) or the DTP may move freely or with a force applied by a user (e.g. with a digit of the user, including a human). The user can simply push the tee into the ground and the DTP will adjust accordingly. Also, a friction fit can be formed between the DTP 14 and the distal portion 22 to assist in holding the DTP 14 in a selected position relative to the distal portion 22. Also, the spikes 34 and 36 can be engaged into a ground surface to assist in stabilizing the tee 10 when a golf ball is placed on the tee head 16.

The DTP can be provided in a selected large size relative to the tee body. The DTP, therefore, can provide a visual for inserting into the ground. Also, the DTP need only protrude to one side of the tee body 22. Thus, the wide or extending side of the DTP can be positioned away from the direction of the intended drive or first golf shot when a golf ball is positioned on the tee head 16. This enables the tee 10 to more efficiently or naturally fall or move in the direction of impact without obstruction from the DTP and/or the ground.

According various embodiments, as illustrated in FIGS. 11-14 a multi-use golf device 110 includes a tee body 112 and a divot tool plow (DTP) 114. The tee body 112 extends from a head portion 116 towards a tee tip 118 and can define all or a portion of the length. The tee tip 118 is generally configured or operable to be pushed into a surface to hold a golf ball on the head portion 116. The tip 118 can also be flattened or generally not circular for engagement into a surface. The multi-use golf device 110 is similar to that described above. The DTP 114, however, includes a ground engaging or push surface 120 that extends at a push angle relative to a long axis 112*a* of the tee body 112. The push angle can be greater than 80 degrees, including greater than or equal to 90 degrees, or an appropriate obtuse angle. The push angle can further be an appropriate angle, such as about 105-130, including about 110-115 degrees, inclusive of all increments of angles. As discussed above, the DTP according to the various embodiments, including the DTP 14, 50 can include the push angle relative to a push surface.

The ground engaging or push surface 120, which can be included on any of the various embodiments of the DTP, can also include a selected geometry other than a flat geometry. For example, the ground engaging surface 120 can include a depression 122. The depression can assist in engaging a dirt or earth mass to assist in repairing a depression in the ground. It will be understood, however, that surface 120 may also include a projection. The projection may be in addition to or in place of the depression 122. Moreover, although the bottom surface can include the depression 122, the outside perimeter of the DTP 114 may be generally square, rectangle, or other generally right angle corners. It will be further understood, however, that the surface 120 may be substantially planar and need not be depressed or flat.

The multi-use golf device 110 can operate to repair a ball mark by rotating the DTP 114 generally in the direction of arrow 150 towards the depression in the ball mark and engaging an edge or raised portion towards the center as the DTP 114 is rotated. An angle of the surface of the plow can be greater than 90 degrees such that rotating the plow surface towards the depression is operable to assist in filling the depression from the edge. Rotating can also assist in more efficiently filling the depression with mass from the edge of the depression and not just pushing material down. It is understood, however, that rotating a multi-use golf device according to any appropriate embodiment may be appropriate.

Figure 15:
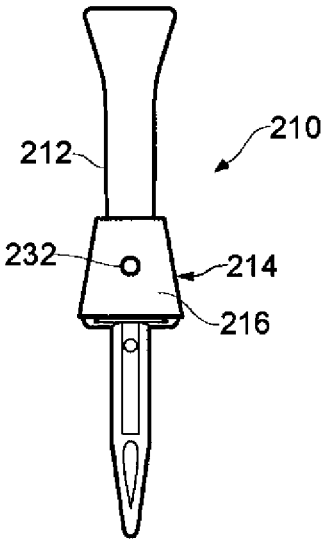
FIG. 15 is a front plan view of a multi-use golf device, according to various embodiments.
Figure 16:
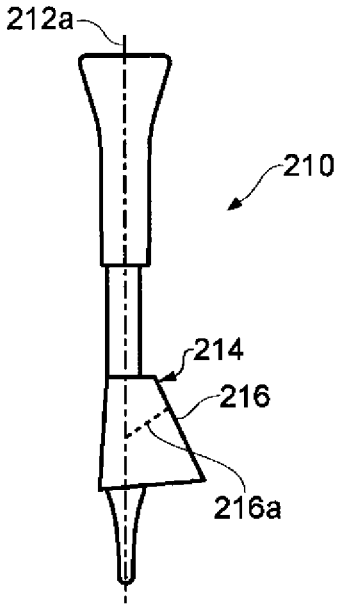
FIG. 16 is a side plan view of the multi-use golf device of FIG. 15, in clouding optional spikes.
Figure 17:
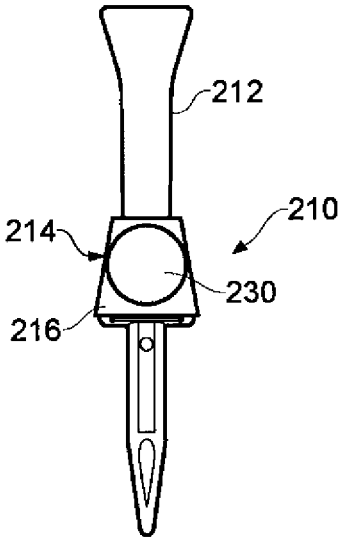
FIG. 17 is a front plan view of a multi-use golf device with an optional removable member, according to various embodiments.

In addition to the various embodiments of the multi-use golf device described above, a multi-use golf device 210, according to various embodiments, is illustrated in FIGS. 15-17. It is understood that the multi-use golf device 210 can include any appropriate combination of features including those discussed below and above. The specific examples illustrated herein are exemplarily combinations.

As illustrated in FIGS. 15-17 the multi-use golf device 210 can include the tee portion 212 and a moveable member that is a divot tool plow (DTP) 214. The divot tool plow 214 includes an exterior (also referred to as a front) surface 216 that is substantially planar. The exterior surface 216 can be formed at a front angle 216*a* relative to a long axis 212*a* of the tee portion 212. The front angle 216*a* can be any appropriate angle and can be about 10 degrees to about 50 degrees. Generally the front angle 216*a* allows a user to engage the exterior surface 216 with a digit (e.g. a finger or thumb) and drive the tee portion 212 generally along or parallel to the long axis 212*a* of the tee portion 212.

When driving the tee portion 212 along the long axis 212*a* the divot tool plow 214 can engage a surface, such as a surface of the earth, at least for the purpose discussed above. For example, the divot tool plow 214 can assist in repairing a ball mark on a surface of a green portion of a golf hole. In another purpose the divot tool plow 214 can be used to adjust an amount that the tee portion 212 of the multi-use golf device 210 can be pushed into a surface for teeing a golf ball.

Figure 14:
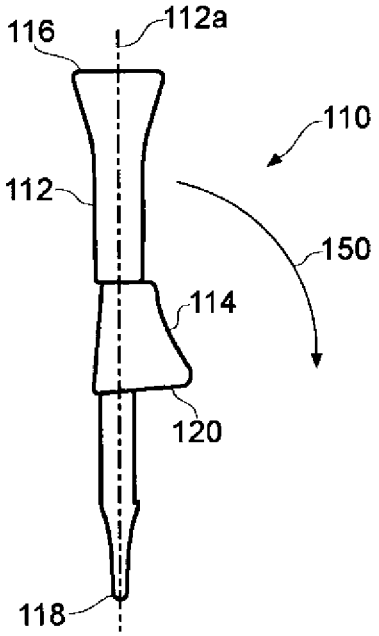
FIG. 14 is a side plan view of a multi-use golf device according to the third embodiment including a tee body and a Divot Tool Plow (DTP)

With reference to FIGS. 11-17, the multi-use golf device 110, 210, operable as a ball teeing device and a divot repair device, can be adjusted and used as follows. A first member that extends from a head portion to a tip portion is moved into a first portion of earth. For example, the first member can include the tee body 112 having the head portion 116 and tee tip 118 as shown in the figures. A second member, such as divot plow tool 114, 214 is in a first position relative to the head portion 116. The head portion 116 is operable to support a golf ball. The divot plow tool 114, 214, which is moveably coupled to the tee body 112, 212, is moved to a second position relative to the tee body 112, 212 that is different than the first position. FIG. 14 shows an example of the divot plow tool 114 in the first position and FIG. 16 shows an example of the divot plow tool 214 in the second position. As can be seen in the transition between FIG. 14 and FIG. 16, the divot plow tool 114, 214 is moved towards the tee tip 118. A second portion of earth is then engaged when the divot plow tool 114, 214 is in the second position. In particular, the divot plow tool 114, 214 can be moved to the second position by moving the divot plow tool 114, 124 closer to the tee tip 118 from a starting point near the head portion 116. Moving the tee body 112 having the head portion 116 and tee tip 118 into the first portion of earth can further include engaging the first portion of earth with the divot plow tool 114, 214 when in the first position. Use of the multi-use golf device 110, 210 can also include selecting an amount of dirt to move, where moving the divot plow tool 114, 214 to the second position includes moving the divot plow tool 114, 214 closer to the tee tip 118 from near the head portion 116 based upon the selected amount of dirt to move. The divot plow tool 114, 214 is accordingly moved a distance toward the tee tip 118 that is inversely proportional to the selected amount of dirt to move. That is, the divot plow tool 114, 214 is moved a greater distance towards the tee tip 118 to repair a smaller divot, while the divot plow tool 114, 214 is moved a lesser distance towards the tee tip 118 to repair a larger divot.

The exterior surface 216 of the divot tool plow 214 can be provided with a removable member 230. The removable member 230 can be held relative to or on the exterior surface 216 by a selected engagement feature. For example the divot tool plow 214 can have a bore 232 (e.g. a blind bore) with an appropriate engaging feature, such as a deformable surface, to capture a peg or arm extending from the removable member 230. The peg or arm can include a complementary positive engaging feature. The positive engaging features can include a ridge and depression or tongue and groove engagement. The divot tool plow 214 can also or alternatively define a ridge or groove for the removable member 230 to fit within when placed on the surface 216. In other words, the exterior surface 216 of the divot tool plow 214 can include features, such as grooves (e.g. exterior grooves) to allow the removable member 230 to be slid and held next to the divot tool plow 214 and generally on the surface 216. Alternatively, or in addition, the exterior surface 216 of the divot tool plow 214 can include an exterior ledge to provide a stop or limit of movement of the removable member 230 relative to the divot tool plow 214 when placing the removable member 230 on or next to the divot tool plow 214.

Regardless of the positive engaging mechanism, the removable member 230 can be selectively removed from the divot tool plow 214. The removable member 230 can be used in the removed manner for various purposes. For example, the removable member can be laid on a green surface to mark a golf ball, as allowed by the USGA rules of golf. Also, the removable member 230 can allow for personalization, ownership information, or other informative features to be applied to the removable member 230 and, therefore, to the golf tool system 210.

The removable member 230 can also be provided with at least one substantially planar surface to lay substantially flat against the exterior surface 216 of the divot tool plow 214. Thus, the removable member 230 need not increase the exterior dimensions of the tee device 210 substantially or at all. This allows the removable member 230 to be used with the multi-use golf device 210 in a variety of manners without altering the other useful features of the golf tool system 210.

It is understood that the DTP according to various embodiments can include all of the features discussed above or combinations thereof. Thus, the DTP as exemplarily illustrated in any particular example is merely exemplary of features that can be included in a DTP. Thus, any embodiments of the DTP can include all disclosed features discussed above and herein.

A multi-use golf device can further include, according to various embodiments, a multi-use golf device 300 illustrated in FIGS. 18-21. The multi-use golf device 300 can include a tee body 302 that extends from a tee tip 304 to a tee head or head portion 306. A body portion 308 extends from the tip potion 304 to the head portion 306. Formed in the body portion 308 is an elongated slot or groove 310 formed between two inner walls 312 and 314.

Figure 18:
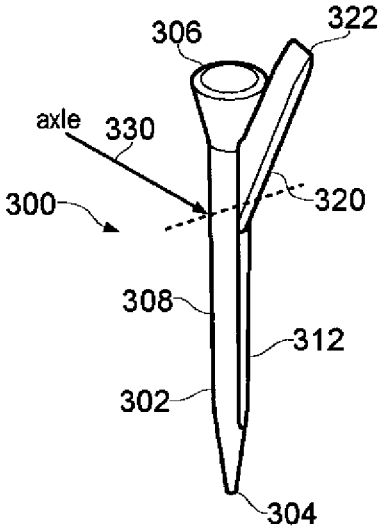
FIG. 18 is a perspective view of a multi-use golf device with an extended wing, according to various embodiments.
Figure 19:
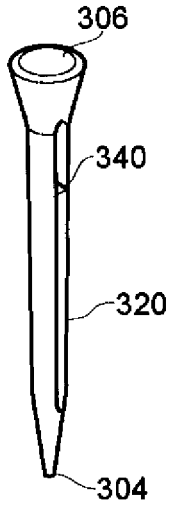
FIG. 19 is a perspective view of the multi-use golf device of FIG. 18 with a collapsed wing.
Figure 20:
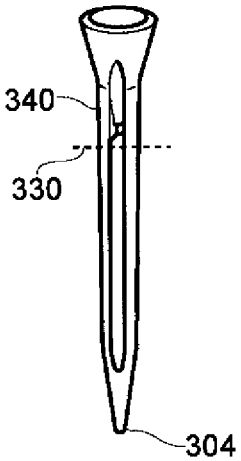
FIG. 20 is a front view of the multi-use golf device of FIG. 18 with a collapsed wing.
Figure 21:
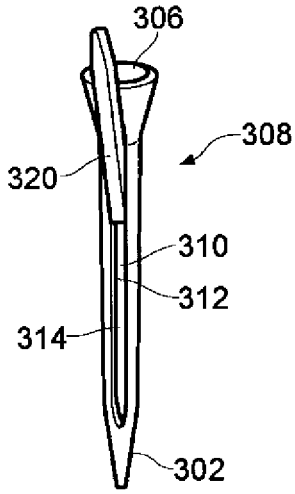
FIG. 21 is a perspective view of the multi-use golf device of FIG. 18 with an extended wing.

The golf tee system 300 further includes a wing or rotating member 320. The wing 320 extends from a tip 322 to an axle or rotating end 324. At the rotating end, the wing 320 is rotatably connected to the tee portion 302. The connection can include an axle 330 that extends through the wing 320 and into or through the inner walls 312, 314. The wing 320 rotates between a collapsed or closed position (as illustrated in FIGS. 19 and 20) and an open or extended position (as illustrated in FIGS. 18 and 21). The slot 310 can extend past an end of the wing 320 towards the head portion 306 (as illustrated in FIG. 20) to form a receiving depression or slot 340. The wing 320, in the open position, can move into the receiving depression as illustrated in FIGS. 18 and 21.

The multi-use golf device 300 can be operated to hold a golf ball in the collapsed or tee configuration, as illustrated in FIGS. 19 and 20. In this orientation the multi-use golf device 300 can operate as a conventional tee for teeing a golf ball. In the expanded configuration, as illustrated in FIGS. 18 and 21, the golf tool system can be used to repair a ball mark. The head portion 306 can operate as a plow similar to the divot tool plow discussed above. The wing tip 322 can be used to engage the earth near the ball mark on the green, as discussed above, while the head portion 306 is operated to flatten or move earth into the depression.

Figure 22:
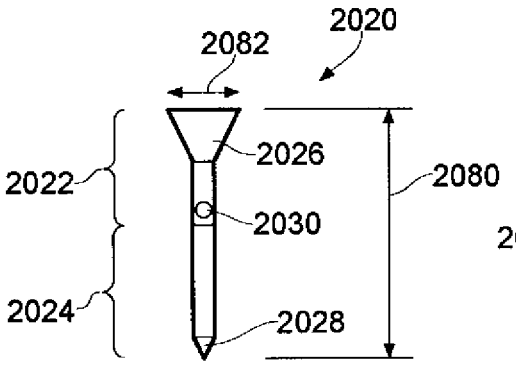
FIG. 22 is an elevation view of a multi-use golf device according to various embodiments.
Figure 22A:
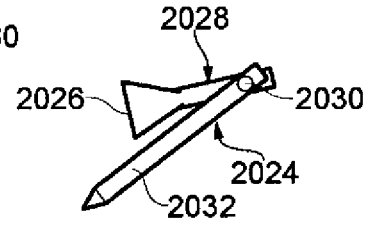
FIG. 22A is an elevation view of a second configuration of the multi-use golf device of FIG. 22.
Figure 24:
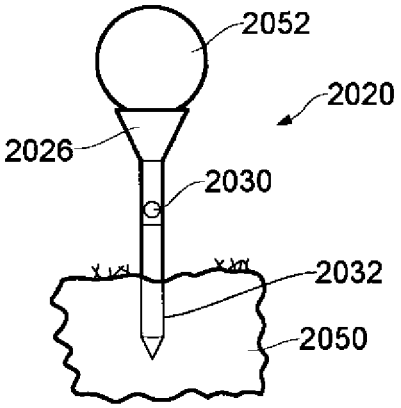
FIG. 24 is a side elevation environmental view of a multi-use golf device according to the embodiments illustrated in FIG. 22 in a tee configuration.
Figure 22B:
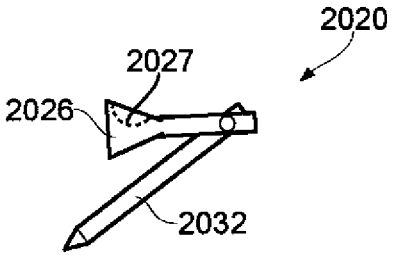
FIG. 22B is an elevation view of a third configuration of the multi-use golf device of FIG. 22.

According to various embodiments, a multi-use golf device can include a multi-use golf device 2020 as illustrated in FIGS. 22, 22A and 22B. The multi-use golf device 2020 can include a first section 2022 and a second section 2024. The first section 2022 can include a top or ball receiving portion 2026 that can generally hold a golf ball in a selected position when the second portion 2024 is positioned within a ground mass, as illustrated in FIG. 25. The second portion 2024 can include a tip or sharpened region 2028 to allow for easy insertion of the multi-use golf device 2020 into the ground. The first section 2022 can rotate or move relative to the second section 2024 around a point or axle 2030.

Figure 23A:
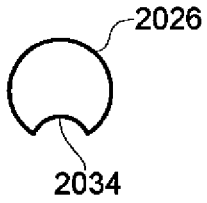
FIG. 23A is a top view of a ball engaging region according to various embodiments.
Figure 23B:
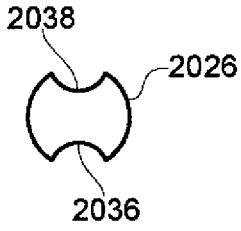
FIG. 23B is a top view of a ball engaging region according to various embodiments.
Figure 23C:
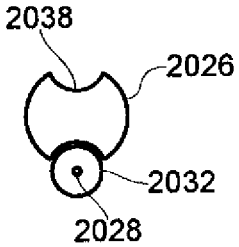
FIG. 23C is a top view of a ball engaging region according to various embodiments.
Figure 23D:
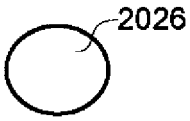
FIG. 23D is a top view of a ball engaging region according to various embodiments.

As illustrated in FIG. 22A the first section 2024 can pivot around the axle 2030 to engage the second section 2028 or at least a shaft 2032 of the second section 2026. The shaft 2032 can be formed in a selected configuration, such as substantially cylindrical shape, to allow for flush engagement of the ball receiving section 2026 onto the shaft 2032. As illustrated in FIGS. 23A, 23B, and 23C the head portion 2026 can include in a single cut out or concave portion 2034 or a first and second cut out portions 2036, 2038. The concave or cut out sections, allow the head portion 2026 to engage the shaft 2032 in a substantially closely engaging manner to allow for the head portion 2026 to be positioned near the shaft 2032. It will be understood, however, is illustrated in FIG. 22B and FIG. 23D that they head portion 2026 need not include any concave portions and the head portion 2026 can just rest against the shaft 2032 in a selected manner.

When in the tee configuration the multi-use golf device 2020 can be pressed into a ground or dirt mass 2050 to allow the head portion 2026 to extend above the surface of the ground mass 2050 to receive a golf ball 2052. The multi-use golf device 2020 can therefore be used as a golf ball tee on the tee ground on a golf course. As discussed above, after one or more strikes of the golf ball 2052 it may rest or impact a golf course green 2060 (see FIG. 25) where the impact of the golf ball 2052 may form a dent or ball mark of 2062 within the green surface. A mound of earth or dirt 2064 may also form near the ball mark 2062 on the green 2060. In the divot tool configuration, as illustrated in FIG. 25, the shaft portion 2032 can engage the indent on the side the head portion 2026 and the multi-use golf device 2020 can be pushed towards the mound of dirt 2064, generally in the direction of arrow 2066. This allows a surface, such as a dirt engaging or ball engaging surface 2068 of the head portion 2026, to press against the mound of dirt 2064 or any portion of the earth near the ball mark 2062 to move the dirt mass into the ball mark 2062 generally in the direction of arrow 2070. A depression 2027, as illustrated in FIGS. 22B and 25, can be provided and may be engaged with a digit of a user to assist in leveraging or providing a contoured surface for ease of engagement of the digit to press the multi-use golf device 2020 to move the dirt mass and repair the divot. The depression 2027 can be curved or otherwise shaped to comfortably engage a digit of the user. This can assist in pressing the dirt mass to repair the ball mark divot. This is generally understood by one skilled in the art to assist in repairing the ball mark 2062 on the green 2060. This allows a golfer to leave the green substantially smooth after a divot or mark is made by a golf ball.

Accordingly the multi-use golf device 2020 can be used to both hold a golf ball 2052 on the tee ground in the tee configuration and to fix a ball mark 2062 on the green 2060 in the tool or ball mark repair configuration. Thus, the multi-use golf device 2020 can be used in at least two configurations and allow a golfer to perform two tasks with the single multi-use golf device 2020 during a round of golf. Additionally, the goofball divot repair tool, being the divot tool configuration of the multi-use golf device 2020, does not add any additional mass or volume to the multi-use golf device 2020 due to the movable nature of the first portion 2022 relative to the second portion 2024 of the multi-use golf device 2020.

The multi-use golf device 2020 can be maintained in a substantially compact configuration and size for a golfer.

Generally, it will be understood that the multi-use golf device 2020 need not be larger than a generally used golf tee. That is, a length 2080 of the multi-use golf device 2020, as illustrated in FIG. 1, can be about two inches to about four inches, and generally within the rules of golf for a length of a golf tee. Additionally, the head 2026 can include a dimension 2082 that is about to 0.25 inches to about 1.5 inches also within the dimensions required by the rules of golf.

Figure 26:
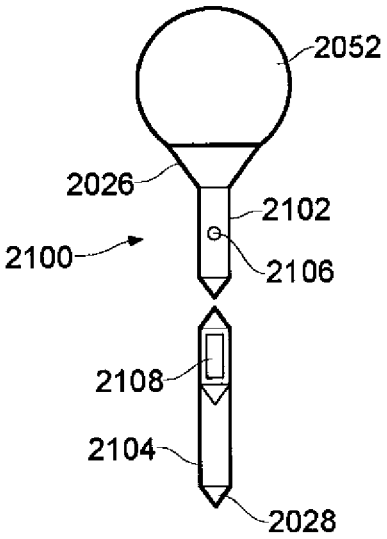
FIG. 26 is a front exploded view of a multi-use golf device according to various embodiments.
Figure 27:
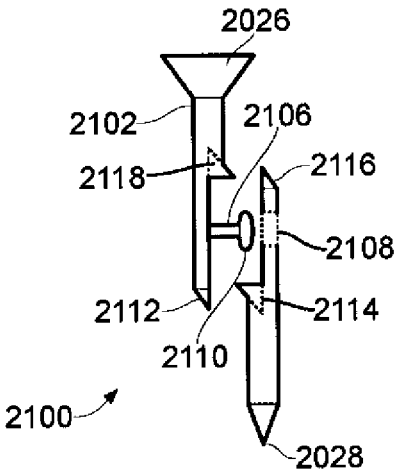
FIG. 27 is a side exploded view of a multi-use golf device according to various embodiments.

Turning reference to FIGS. 26 and 27 a multi-use golf device 2100, according to various embodiments, is illustrated. The multi-use golf device 2100 can also include a tee and a divot tool configuration, as discussed further herein, and generally includes a first section 2102 and a second section 2104. The first section 2102 includes the head portion 2026 that can receive the golf bail 2052, as discussed above. Additionally the second section 2104 includes the tip portion 2028 that can be driven into the ground 2050, also as discussed above. However, the first section 2102 can include a pin or axle 2106 that can be positioned or engaged in a slot 2108. The axle 2106 can include an enlarged portion 2110 that can deflect a slight amount when passed through the slot 2108 and expand or rebound once the enlarged portion has passed through the slot 2108 in the first section 2102. It will be understood, however, that the walls of the slot 2108 may also expand to allow passage of the enlarged portion 2110 and the axle 2106 therethrough. The walls of the slot 2108 can also rebound once the axle 2106 is positioned relative to the second section 2104.

The first section 2102 also includes a second section engaging portion 2112 that can be received within a pocket or hollow 2114 defined within the second section 2104. The second section 2104 can also include a first section engaging portion 2116 that can be positioned within a pocket or recess 2118 of the first section 2102. It will be understood, however, that the first section 2102 and the second section 2104 need only include or may only include either one of the engaging sections 2112, 2116 or the receiving sections 2114, 2118. Accordingly, having both an engaging section and a receiving section on both the first section 2102 and the second section 2104 is not necessary.

The multi-use golf device 2100 can be positioned in the tee configuration by positioning the engaging portion 2112 within the recess 2114 of the second section 2102. The engaging portion 2112 of the first section 2102 can be held within the receiving portion 2114 to hold the first portion 2102 relative to the second portion 2104 in the tee configuration. The physical engagement of the engaging portion 2112 with the recess 2114 allows for selectively holding the first section 2102 relative to the second section 2104 to hold the golf ball 2052 in the tee configuration and for resistance of movement of the first portion 2102 relative to the second portion 2104 while hitting the golf ball off the multi-use golf device 2100 when in the tee configuration.

Figure 28:
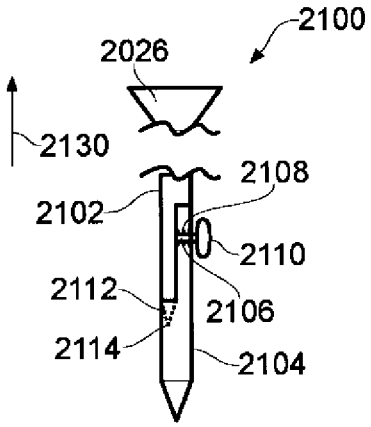
FIG. 28 is a side detail view of a teeing configuration of the multi-use golf device of FIG. 26.
Figure 29:
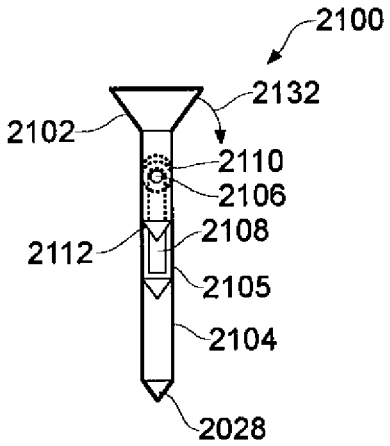
FIG. 29 is a front open configuration of the multi-use golf device of FIG. 26.
Figure 30:
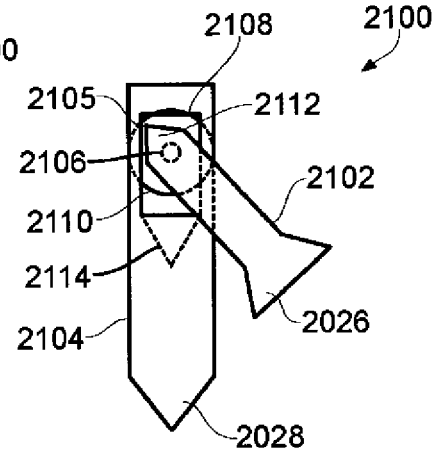
FIG. 30 is a divot tool configuration of the multi-use golf device of FIG. 26.

To move the first portion 2102 to change the configuration, the first portion 2102 can be moved generally in the direction of arrow 2130, as illustrated in FIG. 28, to remove the engaging section 2112 from the recess 2114. The movement of the first portion 2102 relative to the second portion 2104 is allowed due to the slot 2108 not tightly engaging the axle 2106 of the first portion 2102. Thus, the first portion 2102 can be moved enough to disengage the engaging portion 2112 from the recess 2114 and allow the first portion 2102 to be rotated relative to the second portion 2104 generally in the direction of arrow 2132, as illustrated in FIG. 29. The extending or back portion 2105 of the second portion 2104 that defines the slot 2108 and allows the first portion 2102 to rotate in the direction of the arrow 2132, allows the second portion 2104 of the multi-use device 2100 to be moved to the configuration as illustrated in FIG. 30. Again the head portion 2026 in combination with the second portion 2104 can assist in moving and repairing the ball mark 2062, as discussed in relation to FIG. 25. Thus, according to various embodiments, the multi-use golf device 2100 can be used in multiple configurations for both a golf tee to tee the golf ball 2052 and fixing the ball mark 2062 on a putting green 2060.

Figure 31:
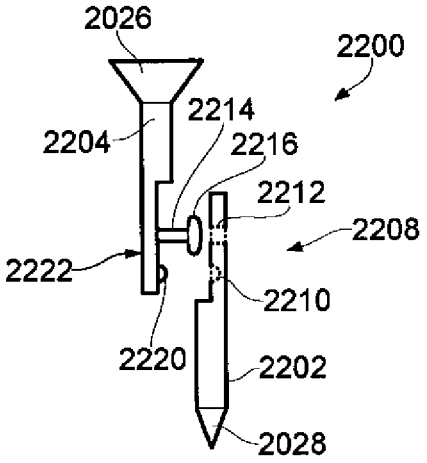
FIG. 31 is a side exploded view of a multi-use golf device according to various embodiments.

According to various additional embodiments the multi-use golf device can be provided as the multi-use golf device 2200 illustrated in FIG. 31. The multi-use golf device 2200 and can be substantially similar to the assembly 2100, discussed above, including a ground engaging portion 2202 that includes the tip 2028 and a ball engaging portion 2204. The ball engaging portion 2204 includes the ball holding part 2026 similar to that described above. The ground engaging portion 2202 can include a coupling region 2208 that includes a first depression 2210 and a passage 2212. The passage 2212 can allow passage of a spindle or axle 2214 relative to the coupling portion 2208. The spindle 2214 can terminate in a bulbous portion or large portion 2216 to assist in holding the ball engaging portion 2202 in place relative to the ground engaging portion 2202.

A projection 2220 can extend from a second coupling region 2222 of the ball engaging portion 2204. The projection 2220 can be received in the recess 2210 in the first coupling portion 2208. In a configuration operable to hold the ball above the ground, the projection 2220 can be received in the depression 2210. To move to a rotated position, similar to the rotated or divot fixing configuration illustrated in FIG. 30, the projection 2220 can be deformed relative to the depression or the depression relative to the projection, to allow rotation of the ball engaging portion 2204 relative to the ground engaging portion 2202. It will also be understood that magnet portions can also be provided near or in place of the depression 2210 and the projection 2222 assists in holding the ball engaging portion 2202 relative to the ground engaging portion 2204 in the teeing configuration. The attractive force of the magnets can be overcome by rotating or in rotating the ball engaging portion 2204 relative to the ground engaging portion 2202.

Figure 32:
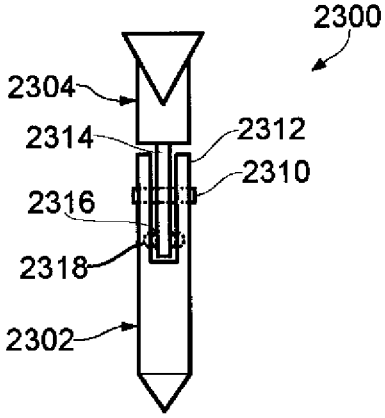
FIG. 32 is a front teeing configuration of a multi-use golf device according to various embodiments.

According to various embodiments, multi-use golf device 2300 is illustrated in FIG. 32. The multi-use golf device 2300 includes a ground engaging portion 2302 and a ball engaging portion 2304. The multi-use golf device 2300 can be similar to the multi-use golf device 2200 and includes an axle 2310 that engages or passes through a first coupling region 2312 extending from the ground engaging portion 2302 and a second coupling portion 2314 extending from the ball engaging portion 2304.

One or more projections 2316 can be formed to extend from the second coupling portion 2314 and mating with depressions 2318 that can be formed in the second coupling region 2312. It will be understood, as discussed above, that the projections and recesses can also be replaced or augmented with magnetic portions to assist in holding the multi-use golf device 2300 in a configuration for providing the ball in the teeing configuration. When the magnetic interactions or the interaction of the projections 2316 and the depression 2318 is overcome, the multi-use golf device 2300 can be rotated into a configuration similar to that illustrated in FIG. 30, discussed above.

According to various embodiments a multi-use golf device 2400 is illustrated in FIG. 33. The multi-use golf device 2400 is similar to the multi-use golf device 2200 discussed in relation to FIG. 31, except that a first projection 2402 and a second projection 2404 are provided on a first coupling portion 2222' and two depressions 2410 and 2412 provided on the second coupling 2208'. The operation of the multi-use golf device 2400 and can be similar to the operation of the multi-use golf device 2200 illustrated in FIG. 31.

According to various embodiments a multi-use golf device 2500 is illustrated in FIGS. 34A-36. As illustrated in FIG. 34A the multi-use golf device 2500 includes a ground engaging portion 2502 that defines or includes the tip 2028. In a distal portion a groove 2504 can be formed in the ground engaging portion 2502. The groove 2504 can extend around the entire ground engaging portion, or only a portion of a distance around the ground engaging portion 2502. Extending above or proximally from the ground engaging groove 2504 can be a projection 2506.

The projection 2506 can extend a distance similar to an external diameter of the ground engaging portion 2502 near the tip 2028. A recess or reduced diameter outer dimension in a proximal region 2508 can be formed to allow for insertion into a bore 2510 of a ball engaging portion 2520, as illustrated in FIG. 35. The bore 2510 can also include an additional recess 2522 to receive the projection 2506 when the ball engaging portion 2520 is assembled (e.g. inserted) into the ground engaging portion 2502. As illustrated in FIG. 34B the ball receiving region 2026 can include a recess or snap 2530 to engage the groove 2504, as illustrated in FIG. 36, in a divot repair configuration.

With reference to FIG. 35 in the teeing configuration the multi-use golf device 2500 can be assembled with the proximal region 2508 received within the bore 2510 of the bail engaging portion 2520. A ball 2532 can be placed on the ball holding portion 2026. The assembled multi-use golf device 2500 can be pushed into a ground or dirt region 2540.

A surface of the ground 2540 can be repaired in the divot repair configuration illustrated in FIG. 36. In the divot repair configuration, the ball receiving portion 2520 can be removed from the ground engaging portion 2502 and the engaging snap 2530 snaps onto the ground engaging portion 2502 in the groove 2504. The snap portion holds the ball engaging portion 2026 closely to the ground engaging portion 2502. The interaction of the groove 2504 with the snap 2530 holes the ball engaging portion axially relative to the ground engaging portion 2502. The divot repair configuration, illustrated in FIG. 36, allows a surface of the ball engaging part 2026 to be used as a surface to engage a mound of dirt created by an impact of the ball 2532, similar to the illustration of FIG. 25 and discussed above. The groove 2504 can be configured to provide a tight snap fit with the snap depression 2530 in the ball engaging surface 2026. Accordingly, the ball engaging portion 2520 will not slide relative to the ground engaging portion 2502 when the multi-use golf device 2500 is used as a divot repair tool.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of adjusting a multi-use golf device operable as a ball teeing device and a divot repair device, comprising:

moving a first member having an elongated portion that extends from a head portion along an axis to a tip portion into a first portion of earth while a second member is in a first position relative to the head portion, wherein the head portion is operable to support a golf ball, the second member is movably coupled to the first member, and the second member includes:

a first surface extending away from the elongated portion and away from the tip portion at a first acute angle relative to a direction perpendicular to the axis to a first surface end; and a second surface extending from the first surface end towards the elongated portion and the head portion at a second acute angle relative to a direction perpendicular to the axis;

wherein a majority of the second member that includes the first and second surfaces protrudes from one side of the first member, the opposite side minimally extending from the elongated portion;

moving the second member that is moveably coupled to the first member to a second position relative to the first member that is different than the first position; and engaging a second portion of earth when the second member is in the second position.

2. The method of claim 1, wherein moving the second member to the second position includes moving the second member closer to the tip portion from near the head portion.

3. The method of claim 2, wherein moving the first member into a first portion of the earth also includes engaging the first portion of earth with the second member when in the first position.

4. A method of adjusting a multi-use golf device operable as a ball teeing device and a divot repair device, comprising:

moving a first member having an elongated portion that extends from a head portion along an axis to a tip portion into a first portion of earth while a second member is in a first position relative to the head portion, wherein the head portion is operable to support a golf ball, the second member is movably coupled to the first member, and the second member includes:

a first surface extending away from the elongated portion and away from the tip portion at a first acute angle relative to a direction perpendicular to the axis to a first surface end; and a second surface extending from the first surface end towards the elongated portion and the head portion at a second acute angle relative to a direction perpendicular to the axis;

moving the second member that is moveably coupled to the first member to a second position relative to the first member that is different than the first position, wherein the second member is moved closer to the tip portion from near the head portion; and engaging a second portion of earth when the second member is in the second position; and selecting an amount of dirt to move;

wherein moving the second member to the second position includes moving the second member closer to the tip portion from near the head portion based upon the selected amount of dirt to move, the second member being moved a distance toward the tip portion that is inversely proportional to the selected amount of dirt to move.

5. The method of claim 1, further comprising:

supporting the golf ball on the head portion at a first time and moving the second member to the second position occurs at a second time different than the first time.

6. The method of claim 1, wherein engaging the second portion of earth when the second member is moved into the second position includes applying a force to the second portion of earth with the second member against the second portion of earth.

7. The method of claim 6, wherein engaging the second portion of earth when the second member is moved into the second position includes pushing the first member and the second member together into and/or against the second portion of earth.

8. A multi-use golf device operable as a ball teeing device and a divot repair device, comprising:

a first member, including:

a golf ball teeing portion defining a concave surface to hold a golf ball, and an elongated portion extending from the golf ball teeing portion and away from the concave surface along an axis towards an end;

a moveable member moveably coupled to the elongated portion and configured to be moved along a length of the elongated portion;

wherein the moveable member, when coupled to the elongated portion, has a first surface extending away from the elongated portion and away from the end at a first acute angle relative to a direction perpendicular to the axis to a first surface end, a second surface extending from the first surface end towards the elongated portion and the golf ball teeing portion at a second acute angle relative to a direction perpendicular to the axis, and a majority of the moveable member that includes the first and second surfaces protrudes from one side of the first member, the opposite side minimally extending from the elongated portion.

9. The device of claim 8, wherein the elongated portion defines a substantially flat surface along at least a portion of the length of the elongated portion.

10. The device of claim 8, further comprising:

a removable member;

wherein the removable member is removably mounted to the second surface.

11. The device of claim 10, wherein the second surface has a bore extending therethrough;

wherein the removable member has a peg extending therefrom configured to be selectively received in the bore.

12. The device of claim 8, wherein the moveable member defines a through passage to moveably receive the elongated portion.

13. The device of claim 12, further comprising:

a detent defined by the elongated member to be engaged by the moveable member to hold the moveable member in a selected position relative to the elongated portion.

14. The device of claim 8, wherein the first acute angle is less than 80 degrees.

15. The method of claim 1, wherein the second member is slidably disposed along a length of the elongated portion of the first member.

16. The method of claim 1, wherein the first surface asymmetrically extends away from the elongated portion of the first member.

17. The device of claim 8, wherein the moveable member is slidably disposed along a length of the elongated portion of the first member.

18. The device of claim 8, wherein the first surface asymmetrically extends away from the elongated portion of the first member.

19. A multi-use golf device operable as a ball teeing device and a divot repair device, comprising:

a tee body including:

an elongated portion having an axis, a first end, and a second end;

a golf ball teeing portion located at the first end; and a tip located at the second end;

a divot tool plow slidably disposed along a length of the elongated portion, the divot tool plow including:

a push surface asymmetrically extending away from the elongated portion; and an exterior surface formed at an acute angle relative to the axis, the acute angle facing the tip of the tee body;

wherein a majority of the divot tool plow that includes the push surface and the exterior surface protrudes from one side of the tee body, the opposite side minimally extending from the elongated portion.

20. The device of claim 19, wherein the divot tool plow defines a through passage that receives the elongated portion, and the elongated portion includes a detent configured to be engaged by the divot tool plow to hold the divot tool plow in a selected position relative to the elongated portion.

* * * * *